US010800182B2

(12) United States Patent
Yamamoto

(10) Patent No.: US 10,800,182 B2
(45) Date of Patent: Oct. 13, 2020

(54) PRINTING SYSTEM, INFORMATION PROCESSING APPARATUS, INKJET PRINTING APPARATUS, PRINTING CONTROL METHOD, AND PRINTING CONTROL PROGRAM

(71) Applicant: DUPLO CORPORATION, Sagamihara-shi (JP)

(72) Inventor: Shuhei Yamamoto, Sagamihara (JP)

(73) Assignee: DUPLO CORPORATION, Sagamihara-Shi, Kanagawa (JP)

( * ) Notice: Subject to any disclaimer, the term of this patent is extended or adjusted under 35 U.S.C. 154(b) by 0 days.

(21) Appl. No.: 16/229,529

(22) Filed: Dec. 21, 2018

(65) Prior Publication Data

US 2019/0193415 A1 Jun. 27, 2019

(30) Foreign Application Priority Data

Dec. 21, 2017 (JP) ..... 2017-245558
Dec. 19, 2018 (JP) ..... 2018-237674

(51) Int. Cl.

| | |
|---|---|
| ***B41J 2/21*** | (2006.01) |
| ***B41J 13/26*** | (2006.01) |
| ***B41J 2/045*** | (2006.01) |
| ***B41J 11/00*** | (2006.01) |
| ***B41J 11/46*** | (2006.01) |
| ***B41J 3/407*** | (2006.01) |

(52) U.S. Cl.
CPC ..... *B41J 2/2142* (2013.01); *B41J 2/04505* (2013.01); *B41J 2/2146* (2013.01); *B41J 3/4073* (2013.01); *B41J 11/002* (2013.01); *B41J 11/0015* (2013.01); *B41J 11/46* (2013.01); *B41J 13/26* (2013.01)

(58) Field of Classification Search
CPC .... B41J 2/2142; B41J 2/2146; B41J 2/04505; B41J 3/4073; B41J 11/0015; B41J 11/002; B41J 11/46; B41J 13/26
See application file for complete search history.

(56) References Cited

FOREIGN PATENT DOCUMENTS

JP 5824712 10/2015
WO WO-2005066881 A1 * 7/2005 ..... B41J 11/663

* cited by examiner

*Primary Examiner* — Thinh H Nguyen
(74) *Attorney, Agent, or Firm* — Ladas & Parry LLP

(57) ABSTRACT

The theoretical position of a registration mark is automatically obtained by image processing on predetermined image data. A printing system including a printing apparatus capable of further performing coating printing on a substrate having undergone printing includes a generator that generates theoretical position data of a registration mark by performing image processing on registration image data assumed to contain a registration mark, an acquirer that acquires reading position data by reading the position of a registration mark printed in advance on conveyed paper, and a printing controller that compares the theoretical position data with the reading position data and corrects a position of coating printing based on the misregistration.

18 Claims, 17 Drawing Sheets

900

PRINTING SYSTEM, INFORMATION PROCESSING APPARATUS, INKJET PRINTING APPARATUS, PRINTING CONTROL METHOD, AND PRINTING CONTROL PROGRAM

CROSS REFERENCE TO RELATED APPLICATIONS

This application is based upon and claims the benefit of priority from Japanese patent application No. 2017-245558, filed on Dec. 21, 2017, and Japanese patent application No. 2018-237674, filed on Dec. 19, 2018, the disclosures of all of which are incorporated herein in their entireties by reference.

BACKGROUND OF THE INVENTION

Field of the Invention

The present invention relates to a printing system, an information processing apparatus, an inkjet printing apparatus, a printing control method, and a printing control program.

Description of the Related Art

In the above technical field, patent literature 1 discloses a technique of reading a registration mark printed together with a base image, detecting misregistration between the reading position of the registration mark and a theoretical position of the registration mark that is acquired in advance, and correcting the printing position of an overlay image for recoating.

[Patent Literature] Japanese Patent No. 5824712

SUMMARY OF THE INVENTION

However, in the technique described in the above literature, a user needs to manually inputting theoretical position data of a registration mark and this is cumbersome.

The present invention enables to provide a technique of solving the above-described problem.

One example aspect of the present invention provides a printing system including a printing apparatus capable of further performing coating printing on a substrate having undergone printing, comprising:

a generator that generates theoretical position data of a registration mark by performing image processing on registration image data assumed to contain a registration mark;

an acquirer that acquires reading position data by reading a position of a registration mark printed in advance on conveyed paper; and a printing controller that compares the theoretical position data with the reading position data and corrects a position of coating printing based on misregistration.

Another example aspect of the present invention provides an information processing apparatus that controls a printing apparatus capable of further performing coating printing on a substrate having undergone printing, comprising:

a generator that generates theoretical position data of a registration mark by performing image processing on registration image data assumed to contain a registration mark;

an acquirer that acquires reading position data by reading a position of a registration mark printed in advance on conveyed paper; and a printing controller that compares the theoretical position data with the reading position data and corrects a position of coating printing based on misregistration.

Still other example aspect of the present invention provides an inkjet printing apparatus that further performs coating printing on a substrate having undergone printing, comprising:

a generator that generates theoretical position data of a registration mark by performing image processing on registration image data assumed to contain a registration mark;

an acquirer that acquires reading position data by reading a position of a registration mark printed in advance on conveyed paper; and a printing controller that compares the theoretical position data with the reading position data and corrects a position of coating printing based on misregistration.

Still other example aspect of the present invention provides a control method of controlling a printing apparatus capable of further performing coating printing on a substrate having undergone printing, comprising:

generating theoretical position data of a registration mark by performing image processing on registration image data assumed to contain a registration mark;

acquiring reading position data by reading a position of a registration mark printed in advance on conveyed paper; and comparing the theoretical position data with the reading position data to correct a position of coating printing based on misregistration.

Still other example aspect of the present invention provides a computer program for causing a computer to execute a method of controlling a printing apparatus capable of further performing coating printing on a substrate having undergone printing, comprising:

generating theoretical position data of a registration mark by performing image processing on registration image data assumed to contain a registration mark;

acquiring reading position data by reading a position of a registration mark printed in advance on conveyed paper; and comparing the theoretical position data with the reading position data to correct a position of coating printing based on misregistration.

According to the present invention, the theoretical position of a registration mark can be automatically obtained by image processing on predetermined image data.

DESCRIPTION OF THE EXAMPLE EMBODIMENTS

Example embodiments of the present invention will now be described in detail with reference to the drawings. It should be noted that the relative arrangement of the components, the numerical expressions and numerical values set forth in these example embodiments do not limit the scope of the present invention unless it is specifically stated otherwise.

First Example Embodiment

A printing system 100 as the first example embodiment of the present invention will be described with reference to FIG. 1. The printing system 100 is a system for controlling an inkjet printing apparatus that performs image printing using a registration mark.

Figure 1:
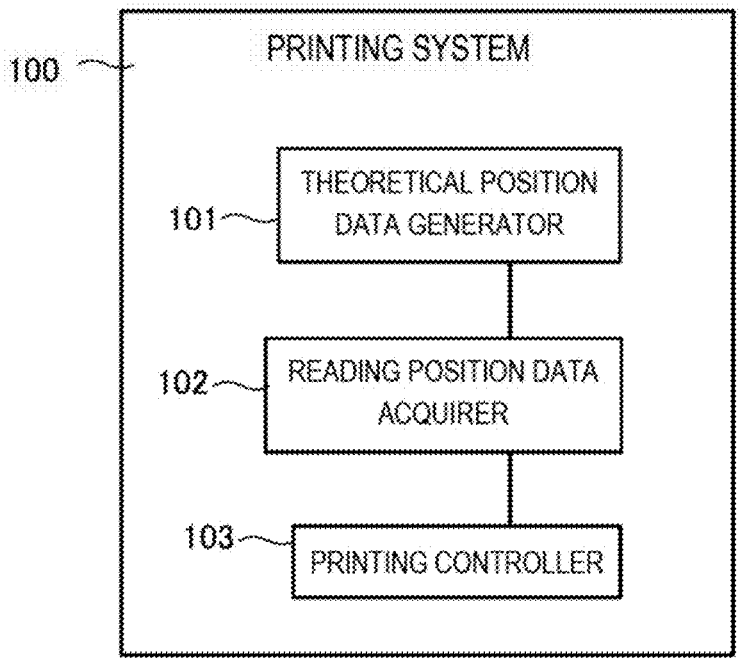
FIG. 1 is a block diagram showing the arrangement of a printing system according to the first example embodiment of the present invention.

As shown in FIG. 1, the printing system 100 includes a theoretical position data generator 101, a reading position data acquirer 102, and a printing controller 103.

The theoretical position data generator 101 generates theoretical position data of a registration mark by performing image processing on image data in which a registration mark is arranged. The theoretical position data is constituted as coordinate data in the image data in which the registration mark is arranged or vector data, and an array or matrix including them.

The reading position data acquirer 102 acquires reading position data by reading the position of a registration mark printed in advance on conveyed paper.

The printing controller 103 compares theoretical position data and reading position data of a registration mark and corrects the printing position based on the misregistration between these positions.

According to this arrangement, the theoretical position of a registration mark can be automatically specified by only inputting image data without performing cumbersome input or embedding of theoretical position data.

Second Example Embodiment

<Arrangement of Printing System>

Figure 2:
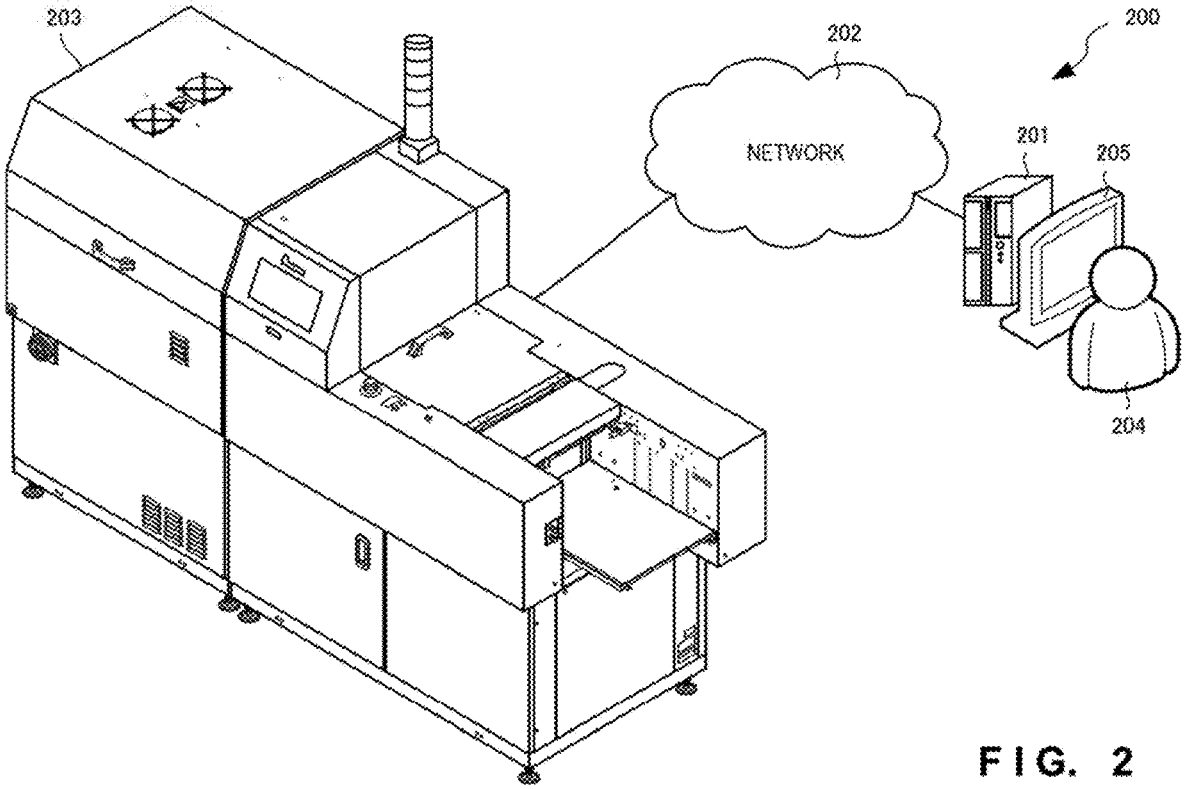
FIG. 2 is a view showing the arrangement of a printing system according to the second example embodiment of the present invention.

A printing system 200 according to the second example embodiment of the present invention will now be described with reference to FIG. 2 and subsequent drawings. FIG. 2 shows the schematic arrangement of the printing system 200. The printing system 200 is a system in which an information processing apparatus 201 and an inkjet printing apparatus 203 are connected via a network 202. The inkjet printing apparatus 203 has a mechanism capable of printing using active energy ray curing ink (for example, so-called ultraviolet curing ink, that is, UV (UltraViolet) ink) in addition to normal ink. A user 204 can perform desired image printing by controlling the inkjet printing apparatus 203 via the network 202 using a screen displayed on a display 205 by the information processing apparatus 201.

<Arrangement of Printed Product>

Figure 3:
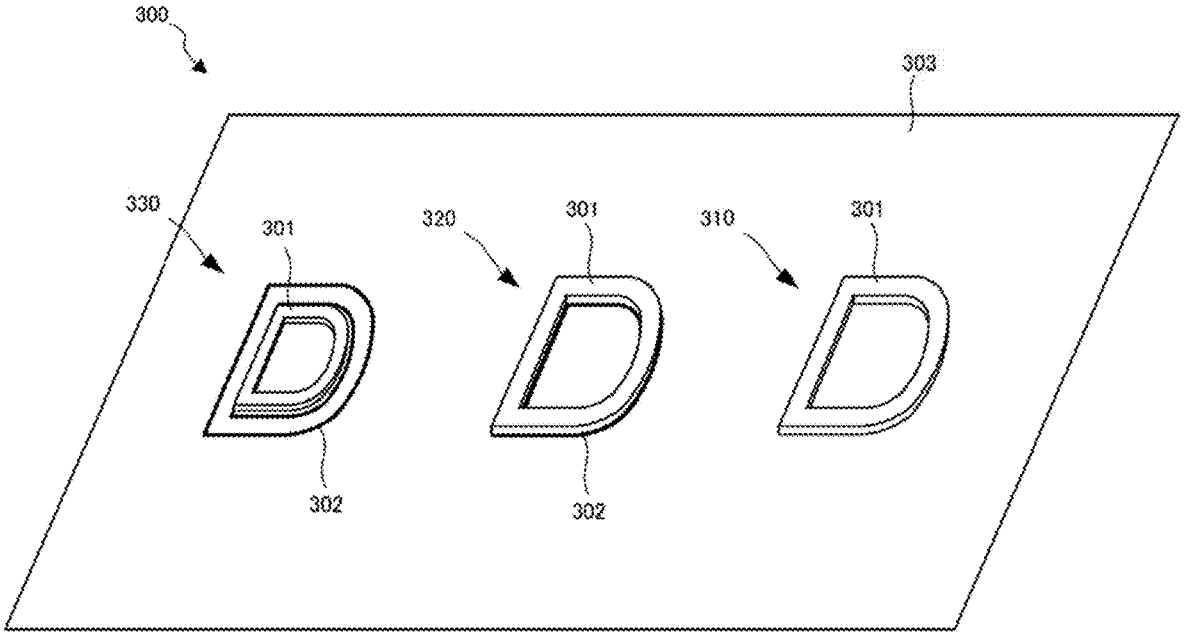
FIG. 3 is a view showing an example of printing by the printing system according to the second example embodiment of the present invention.

FIG. 3 is a perspective view of a product 300 printed using active energy ray curing ink. As shown in FIG. 3, the printed product 300 is obtained by forming base images 302 and coating print images 301 on a substrate 303 such as paper.

The coating print image 301 (also called an overprint image) by active energy ray curing ink is formed with a three-dimensional shape rising in the vertical direction on the substrate 303 by using an inkjet printing apparatus or the like. For example, the coating print image 301 has an alphabetic letter D shape. As shown in FIG. 3, the coating print image 301 may be printed directly on the surface of the substrate 303 on which nothing is printed (310) or may be printed on the base image 302 printed beforehand on the substrate 303 (320).

When the substrate 303 is viewed from a plane, the coating print image 301 may be formed in the same shape as that of the base image 302 at almost the same position (320), or formed in a different shape at a position intentionally shifted from the base image 302 (330).

This coating printing has an effect of adding a matt or glossy texture to a base image printed on a substrate to accentuate the design, and also has an effect of causing an aesthetic feeling different from conventional two-dimensional printing by a three-dimensional design of coating itself.

Examples of the substrate 303 are printing paper such as plain paper, art paper, photographic paper, business card paper, postcard, coated paper, matt coated paper, pure paper, and special paper, plastic substrates such as polycarbonate, rigid polyvinyl chloride, flexible polyvinyl chloride, polystyrene, foamed styrol, PMMA, polypropylene, polyethylene, and PET, laminated films obtained by laminating these plastic substrates, materials obtained by mixing or modifying these plastic substrates, glass, metal substrates such as stainless steel, and wood. However, the present invention is not limited to these materials.

As the active energy rays, ultraviolet rays, electron rays, and the like can be used.

<Arrangement of Inkjet Printing Apparatus>

Figure 4:
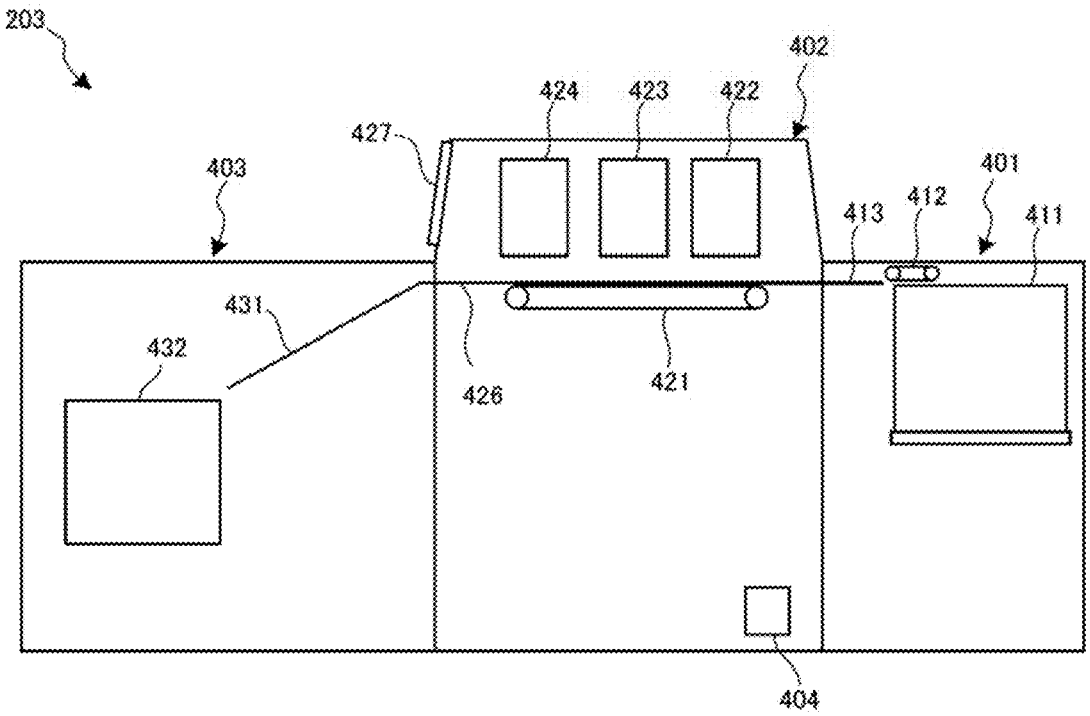
FIG. 4 is a view showing the internal arrangement of an inkjet printing apparatus according to the second example embodiment of the present invention.

FIG. 4 is a view schematically showing the inside of the inkjet printing apparatus 203 according to this example embodiment. The inkjet printing apparatus 203 can execute coating print processing of, for example, forming a coating from active energy ray curing ink on a substrate on which a base image has been printed in advance, so as to coat the base image. The inkjet printing apparatus 203 also executes processing of forming a coating from active energy ray curing ink on a substrate on which no image is formed by printing.

The inkjet printing apparatus 203 includes a conveyance element 401, a coating image printing device 402, and a stacker 403. The conveyance element 401 includes a substrate table 411 and a substrate supply mechanism 412. On the substrate table 411, substrates on each of which a base image has been printed in advance by another electrophotographic printing apparatus are stacked. Note that the base printing is not limited to the electrophotographic method and may be any printing method such as the inkjet method or the offset method.

The substrate table 411 is vertically movable, and the substrate supply mechanism 412 supplies the uppermost one of the stacked substrates. The conveyance element 401 includes the substrate table 411 and the substrate supply mechanism 412, and conveys substrates.

A substrate to be conveyed by the conveyance element 401 is not particularly limited as long as the substrate is a material on which an image can be printed. Examples are paper, a sheet such as surface-processed paper, a plastic plate, and a thin metal film.

The substrate fed by the substrate supply mechanism 412 is conveyed along a conveyance path 413. The coating image printing device 402 is installed along a downstream-side portion of the conveyance path 413. The coating image printing device 402 includes a belt conveyor mechanism 421 for conveying the substrate conveyed along the conveyance path 413. The belt conveyor mechanism 421 conveys the substrate while chucking the substrate on the conveyance surface by an air suction force through holes formed in the belt. Above the belt conveyor mechanism 421, an image reader 422, an inkjet head unit 423, and an active energy ray irradiator 424 are installed from the upstream side in the conveyance direction of the substrate.

A discharge path 426 is connected to the downstream side of the coating image printing device 402. The substrate conveyed from the belt conveyor mechanism 421 is supplied to the discharge path 426. The substrate supplied to the discharge path 426 is unloaded to the stacker 403. The stacker 403 includes a conveyance path 431 and a substrate storage 432. The substrate unloaded from the discharge path 426 passes through the conveyance path 431, and is discharged to and stored in the substrate storage 432.

In a modification, instead of the conveyance element 401, a printer for printing a base image may be directly connected to the coating image printing device 402. Also, instead of the stacker 403, a device for performing post-processing to cut and bind supplied substrates may be connected to the coating image printing device 402.

The inkjet printing apparatus 203 includes an electronic controller 404. The electronic controller 404 includes a CPU for executing various kinds of arithmetic processing, a ROM storing various control programs, and a RAM used as a work area for storing data and executing programs. The electronic controller 404 controls the operation of an actuator installed in the inkjet printing apparatus 203, and the like. Coating print processing is executed by discharging the active energy ray curing ink from the inkjet head unit 423 toward a substrate.

Similarly, the electronic controller 404 executes processing of discharging the active energy ray curing ink from the inkjet head unit 423 toward a substrate on which no image is formed by printing, and forming a coating layer from this ink.

The inkjet printing apparatus 203 includes an operation panel 427, and the user can make various settings of coating print processing by inputting operations via the operation panel 427. In a modification, the display, mouse, and keyboard of the information processing apparatus 201 may function as an operation panel, and the information processing apparatus 201 may function as the electronic controller 404.

Figure 5:
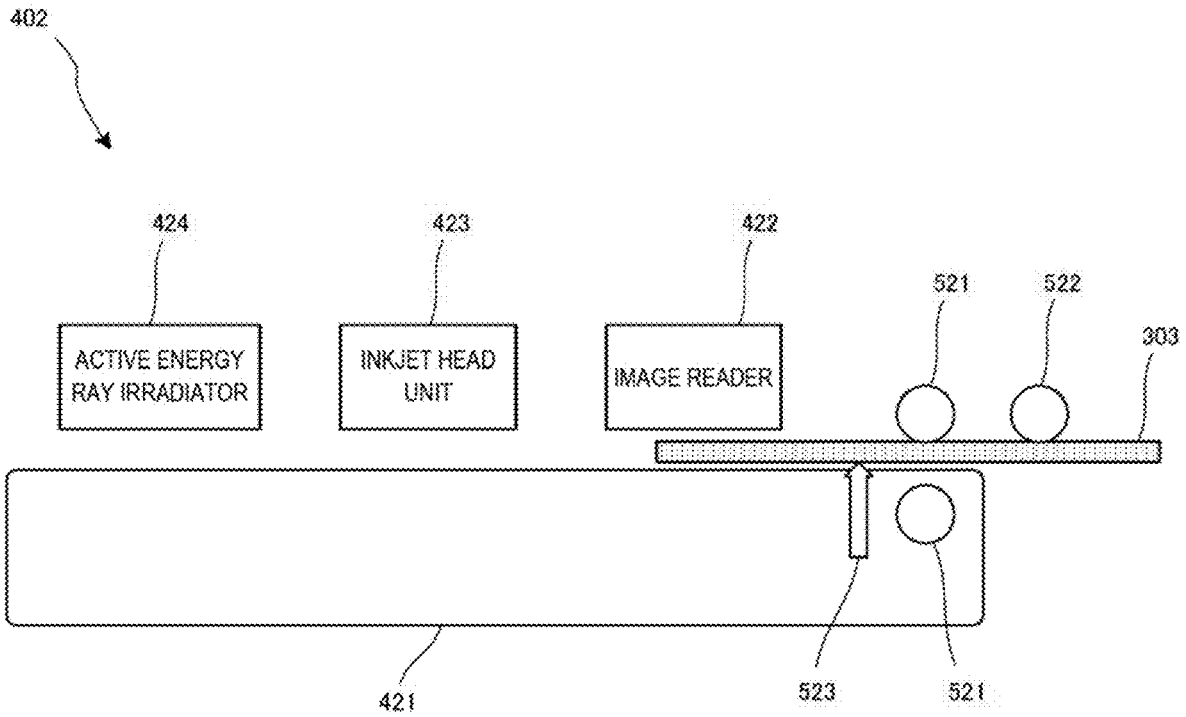
FIG. 5 is a view schematically showing details of a main part of the inkjet printing apparatus according to the second example embodiment of the present invention.

FIG. 5 is a view schematically showing details of the coating image printing device 402 serving as a main part of the inkjet printing apparatus 203. FIG. 5 is a side view of the coating image printing device 402. As shown in FIG. 5, the coating image printing device 402 includes a plurality of conveyor rollers 521 for conveying the substrate 303, as a part of the belt conveyor mechanism 421.

Figure 6:
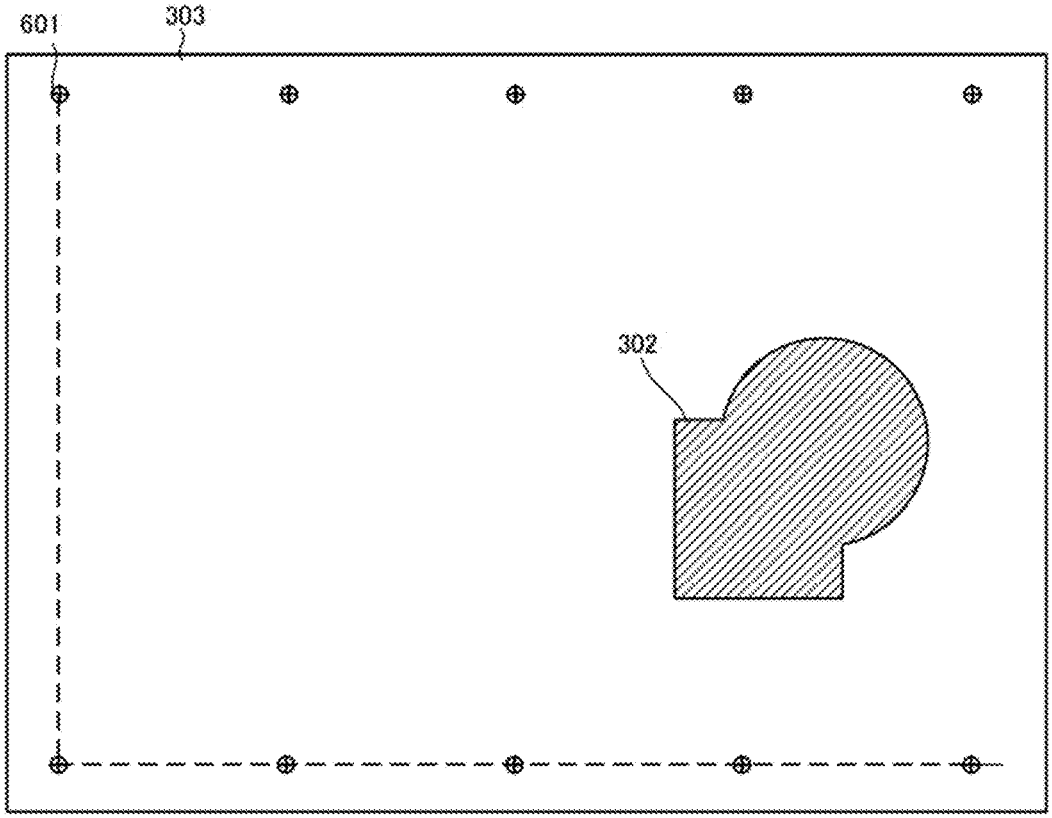
FIG. 6 is a view showing an example of a substrate which is used in the inkjet printing apparatus according to the second example embodiment of the present invention and on which a base image and registration marks are printed.

As shown in FIG. 6, a substrate on which the base image 302, and registration marks 601 serving as references for specifying the position of the base image are printed is prepared as the substrate 303. The registration mark 601 is, for example, a mark of a cross contained in a 4-mmϕ circle. The registration marks 601 are arranged at equal intervals in a line along two long sides of the substrate 303 and arranged at symmetrical positions in the short side direction.

Note that the shape of the registration mark 601 is not limited to this and is desirably any characteristic shape contained in a contour having any geometric shape at a size easy to capture. Examples are a triangle, circle, or asterisk contained in a circle.

The registration marks 601 are printed at the same time as the base image 302 and included in the base image-printed substrate 303. By capturing an image of the substrate 303 and performing object analysis, the positions of the registration marks 601 of a predetermined shape on the substrate 303 are analyzed and the reading positions of the registration marks are specified.

As shown in FIG. 5, an encoder 522 (a rotary encoder) for calculating the conveyance amount of the substrate 303 from the rotational speed is installed on the upstream side of the image reader 422. Also, an entering substrate sensor 523 for sensing the leading end of the substrate 303 conveyed from the conveyance element 401 is interposed between the image reader 422 and the encoder 522.

The electronic controller 404 acquires an output pulse from the encoder 522 by using the sensing of the substrate 303 by the entering substrate sensor 523 as a trigger, and calculates the conveyance position of the substrate 303. Based on the position of the substrate 303, the electronic controller 404 sets the timing of image capturing by the image reader 422, the timing of discharge of the active energy ray curing ink by the inkjet head unit 423, and the timing of irradiation of active energy rays by the active energy ray irradiator 424.

Figure 7:
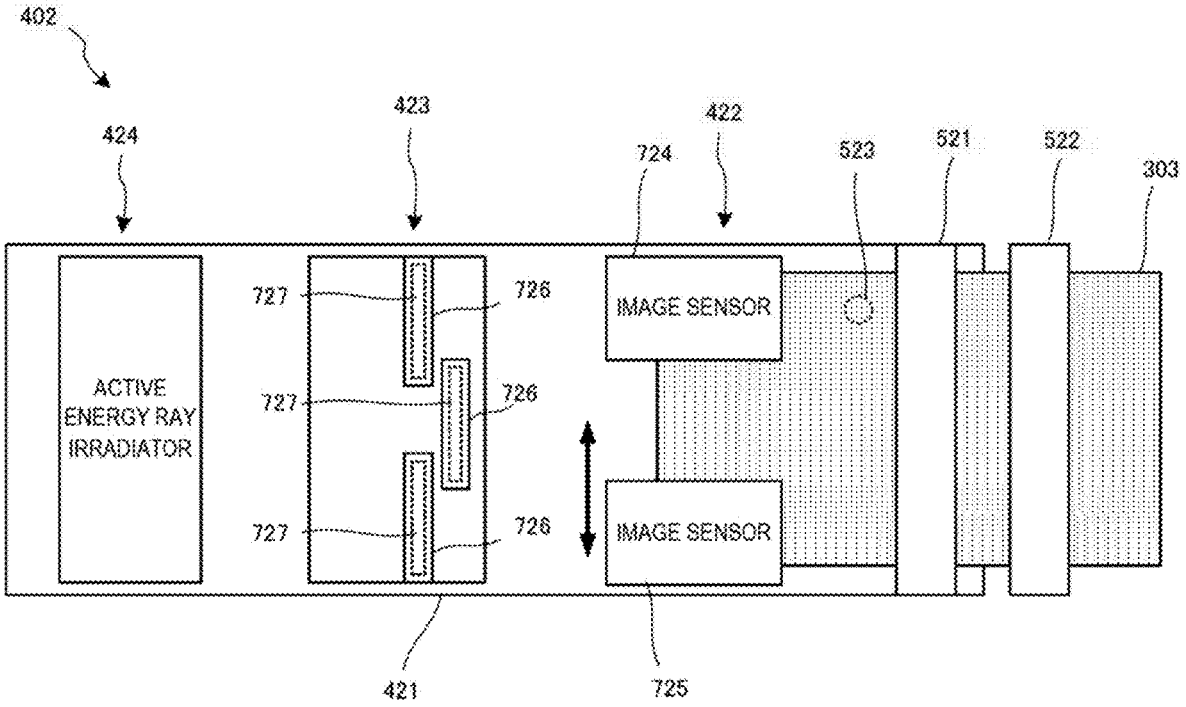
FIG. 7 is a view schematically showing details of a main part of the inkjet printing apparatus according to the second example embodiment of the present invention.

As shown in FIG. 7, the image reader 422 includes a pair of image sensors 724 and 725 arranged apart from each other in the widthwise direction of the substrate above the belt conveyor mechanism 421. The image sensors 724 and 725 are preferably CCD (Charge Coupled Device) sensors but may also be constituted by CMOS (Complementary Meta-Oxide-Semiconductor) sensors or other image sensors.

The image sensor 724 is fixed on one edge in the widthwise direction (the longitudinal direction in FIG. 7) of the substrate 303, and the image sensor 725 is provided on the other edge in the widthwise direction of the substrate 303 so as to be movable in the widthwise direction of the substrate 303. That is, the interval between the image sensors can be adjusted in accordance with the size of the substrate 303 by moving the image sensor 725 in the widthwise direction of the substrate. The image sensors 724 and 725 capture images at a predetermined timing based on a position of the substrate 303 that is calculated by the encoder 522. The image capturing timing is determined in advance based on the theoretical positions of the registration marks 601 that are stored in a storage 844. At this time, when a pair of registration marks exists near opposite sides facing in the longitudinal or lateral direction among the theoretical positions of the registration marks, their theoretical positions are set as image capturing positions by the image sensors 724 and 725.

The electronic controller 404 recognizes "misregistration" between the theoretical positions of the registration marks 601 that are stored in the storage 844 and the measured positions of the registration marks 601 included in a captured image. The discharge position of the active energy ray curing ink from inkjet heads 726 is corrected in accordance with the recognized "misregistration", and the base image 302 and a coating print image can be aligned correctly. While the substrate 303 passes through the image sensors 724 and 725, an image in which the measured positions of the registration marks 601 should be acquired may be selected from images continuously captured by the image sensors 724 and 725 based on the theoretical positions of the registration marks 601.

Note that the registration marks 601 are arranged at equal intervals in a line along two long sides of the substrate in FIG. 6. However, this arrangement is merely an example and the registration marks 601 need always be arranged neither at equal intervals nor in a line. In short, it is enough to read the registration marks 601 by the image sensors 724 and 725, compare the measured positions with theoretical positions stored in advance, and recognize "misregistration".

The inkjet head unit 423 includes three inkjet heads 726 for discharging the active energy ray curing ink to the substrate 303. The three inkjet heads 726 function as so-called "printheads". The active energy ray curing ink discharged from the inkjet heads 726 is cured by active energy rays emitted from the active energy ray irradiator 424.

The inkjet head unit 423 includes heaters 727 for keeping the temperature constant. The locations of the heaters 727 of the inkjet head unit 423 are not particularly limited as long as the temperature of the inkjet head unit 423 can be kept constant. That is, the heaters 727 may be installed outside or inside the inkjet head unit 423 or may be installed both outside and inside it.

The inkjet head unit 423 is arranged above the belt conveyor mechanism 421. In the inkjet head unit 423, the inkjet heads 726 are provided in a line so that nozzles are aligned equally in a direction perpendicular to the conveyance direction of the substrate conveyed by the belt conveyor mechanism 421. Further, the inkjet heads 726 are arranged to overlap each other so as not to form any gap between adjacent inkjet heads 726.

The number of inkjet heads 726 is not limited to three and may be two or four or more. The inkjet heads 726 may also be a single inkjet head 726 elongated in the widthwise direction of the substrate 303. Discharge holes of the inkjet heads 726 may also be skewed and arranged at a predetermined angle to the widthwise direction of the substrate. That is, the discharge holes of the inkjet heads 726 may also be arranged in a predetermined direction which is not parallel to the conveyance direction of the substrate. As the inkjet head 726, it is possible to use an inkjet head 726 that includes two or more lines and discharges the active energy ray curing ink from the lines at the same time.

The active energy ray irradiator 424 irradiates, with active energy rays, the active energy ray curing ink applied on the substrate 303 conveyed from the upstream side, thereby curing the ink layer.

Figure 8:
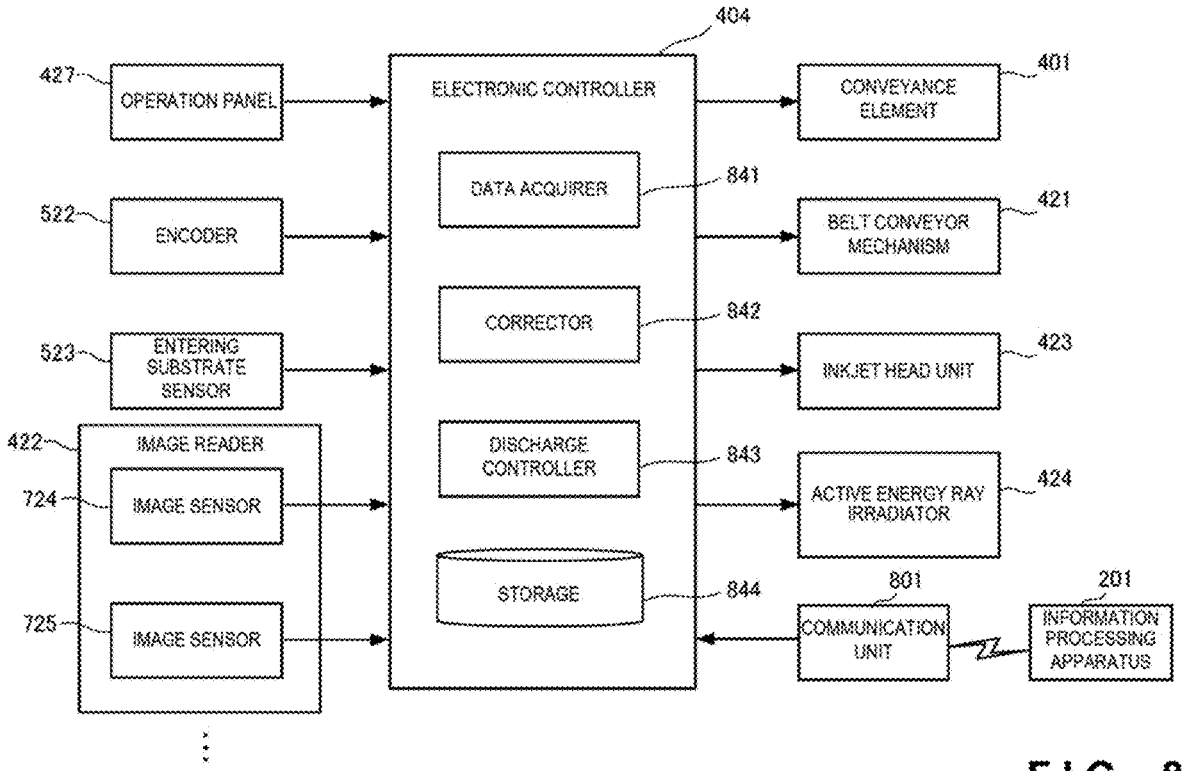
FIG. 8 is a block diagram showing an electrical arrangement centered on the electronic controller of the inkjet printing apparatus according to the second example embodiment of the present invention.

FIG. 8 is a functional block diagram showing an electrical configuration centered on the electronic controller 404 of the inkjet printing apparatus 203. These functions are implemented by cooperation of software and hardware such as a CPU (Central Processing Unit) for executing various kinds of arithmetic processing, a ROM (Read Only Memory) storing various control programs, and a RAM (Random Access Memory) used as a work area for storing data and executing programs. These functional blocks can be implemented in various forms by combining hardware and software.

The electronic controller 404 includes a data acquirer 841, a corrector 842, a discharge controller 843, and the storage 844.

The data acquirer 841 acquires coating image data (including information about color, position, shape, and thickness) from the information processing apparatus 201 via a communication unit 801.

The storage 844 stores image data (so-called CMYK data) of a base image and image data (so-called varnish plate or special color plate) of the coating print image that are acquired by the data acquirer 841. The storage 844 stores information about the printing positions of the registration marks 601 on the substrate 303 and their shape.

The discharge controller 843 refers to the coating image data stored in the storage 844 and controls the discharge amount of active energy ray curing ink so as to coat with the ink the substrate 303 bearing the base image.

The corrector 842 corrects the coating image data based on the theoretical positions of the registration marks read out from the storage 844 and the reading positions of the actual registration marks read by the image sensors 724 and 725.

The corrector 842 calculates a difference between the theoretical positions of the registration marks derived by image processing and the reading positions acquired by reading the substrate, and executes position correction processing on the coating image data to compensate for the difference.

The electronic controller 404 receives a signal acquired from the information processing apparatus 201 via the communication unit 801 and a signal from the operation panel 427. The operation panel 427 includes various switches such as a start switch for starting coating print processing and a stop switch for stopping coating print processing.

The electronic controller 404 also receives sensing signals from the encoder 522, the entering substrate sensor 523, the image sensors 724 and 725, and the like. Based on these switch/sensor inputs, the electronic controller 404 executes predetermined arithmetic processing for supplied substrate control, conveyance control, active energy ray curing ink discharge control, active energy ray irradiation control, and the like. Also, the electronic controller 404 outputs control instruction signals to the conveyance element 401, the belt conveyor mechanism 421, the inkjet head unit 423, the active energy ray irradiator 424, and the like.

Figure 9:
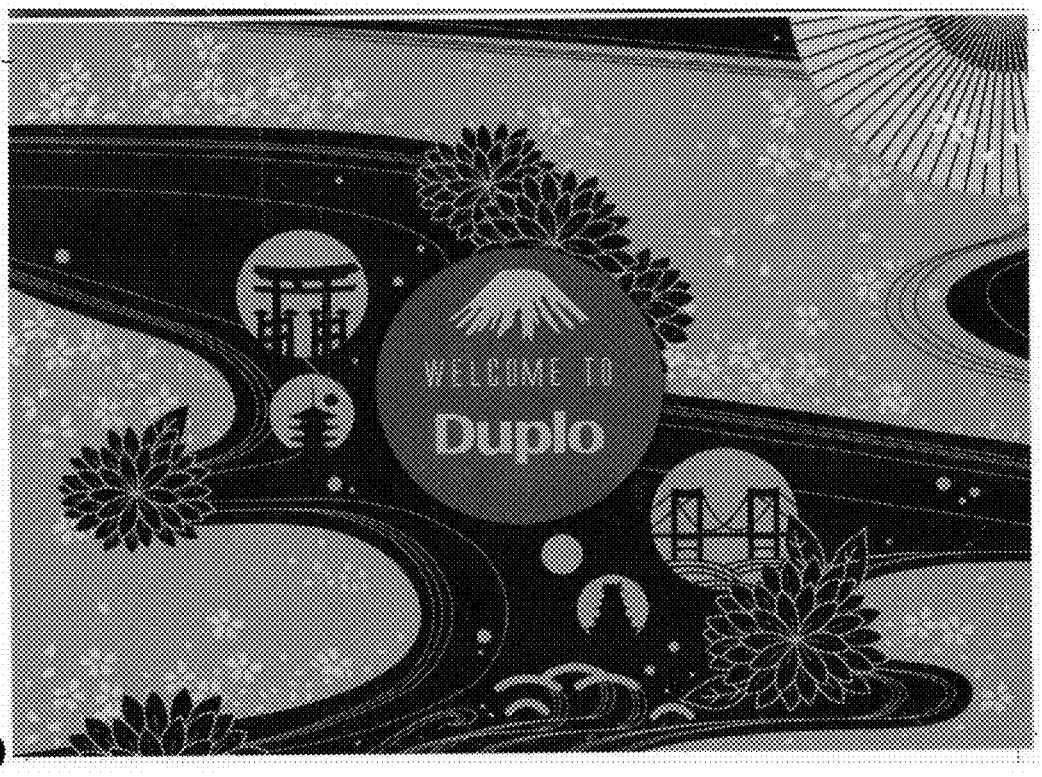
FIG. 9 is a view showing an example of a product printed using the inkjet printing apparatus according to the second example embodiment of the present invention.
Figure 10:
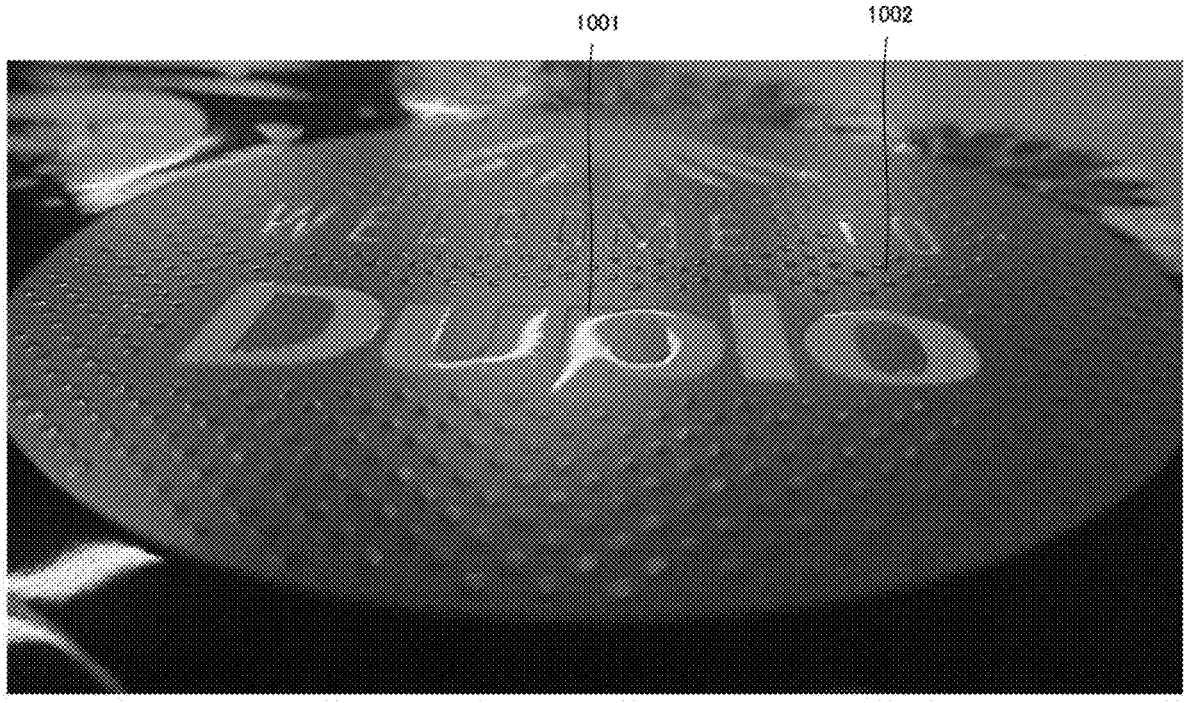
FIG. 10 is an enlarged view showing the example of the product printed using the inkjet printing apparatus according to the second example embodiment of the present invention.

FIG. 9 is a view showing an example of a printed product 900 formed using the inkjet printing apparatus 203. FIG. 10 is an enlarged view of a part of FIG. 9.

As shown in FIG. 10, the printed product 900 includes a coating print image 1001 having a three-dimensional shape rising in the vertical direction while maintaining almost the same shape as that of a base image, and a coating print image 1002 formed in a shape and at a position that are different from those of the base image.

<Arrangement of Information Processing Apparatus>

Figure 11:
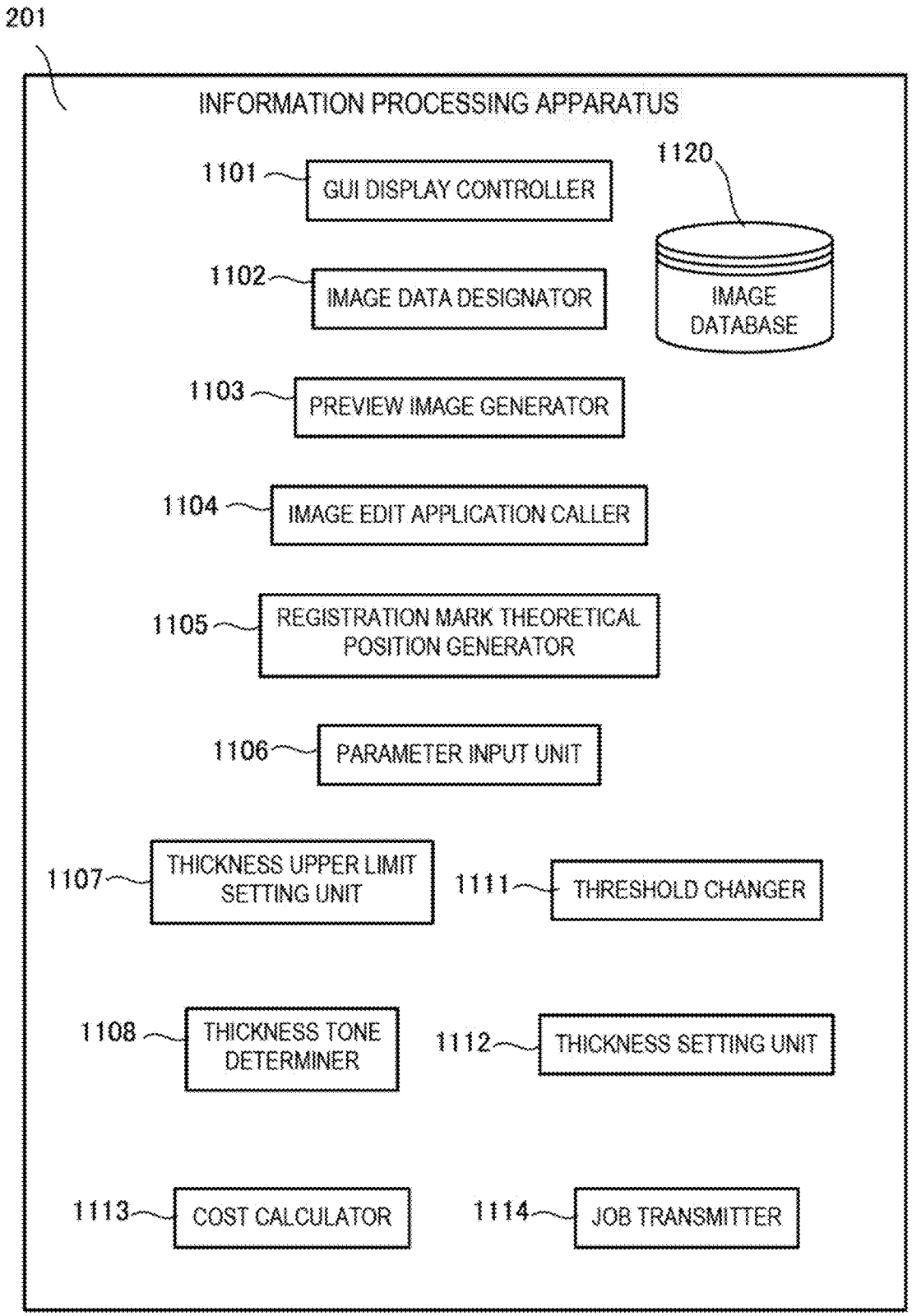
FIG. 11 is a block diagram showing the functional arrangement of an information processing apparatus according to the second example embodiment of the present invention.

FIG. 11 is a block diagram showing the internal arrangement of the information processing apparatus 201. The information processing apparatus 201 includes a GUI (Graphical User Interface) display controller 1101, an image data designator 1102, a preview image generator 1103, an image edit application caller 1104, and the registration mark theoretical position generator 1105. The information processing apparatus 201 further includes a parameter input unit 1106, a thickness upper limit setting unit 1107, a thickness tone determiner 1108, a threshold changer 1111, a thickness setting unit 1112, a cost calculator 1113, and a job transmitter 1114.

These functions are implemented by cooperation of software and hardware such as a CPU (Central Processing Unit) for executing various kinds of arithmetic processing, a ROM (Read Only Memory) storing various control programs, and a RAM (Random Access Memory) used as a work area for storing data and executing programs. These functional blocks can be implemented in various forms by combining hardware and software.

Figure 12:
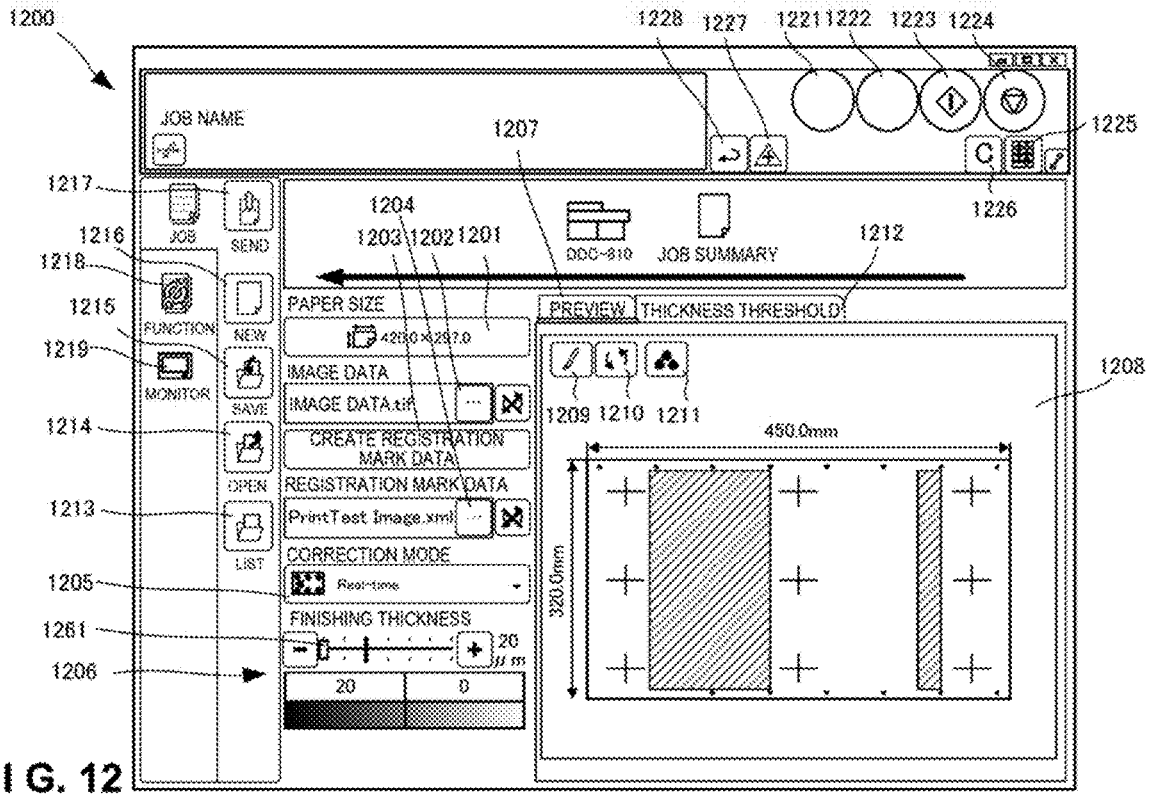
FIG. 12 is a view showing a user interface displayed by the information processing apparatus according to the second example embodiment of the present invention.

By using these functions, the information processing apparatus 201 provides a graphical user interface for adjusting the correspondence between a region in image data and the thickness (coating thickness) of coating printing on a substrate. FIG. 12 is a view showing an example of a graphical user interface 1200.

The GUI display controller 1101 provides the user interface 1200 shown in FIG. 12 on the display 205.

The image data designator 1102 designates image data for coating printing from image data stored in an image database 1120 in accordance with an input from the user to the user interface 1200. The preview image generator 1103 generates a preview image by using the image data designated by the image data designator 1102.

The image edit application caller 1104 calls an application for editing the image data designated by the image data designator 1102 in accordance with the input from the user to the user interface 1200.

The registration mark theoretical position generator 1105 generates theoretical position data of registration marks by performing image processing on registration image data that is assumed to contain registration marks. Even for an image containing many registration marks, theoretical position data of each registration mark can be derived easily and quickly.

Figure 13A:
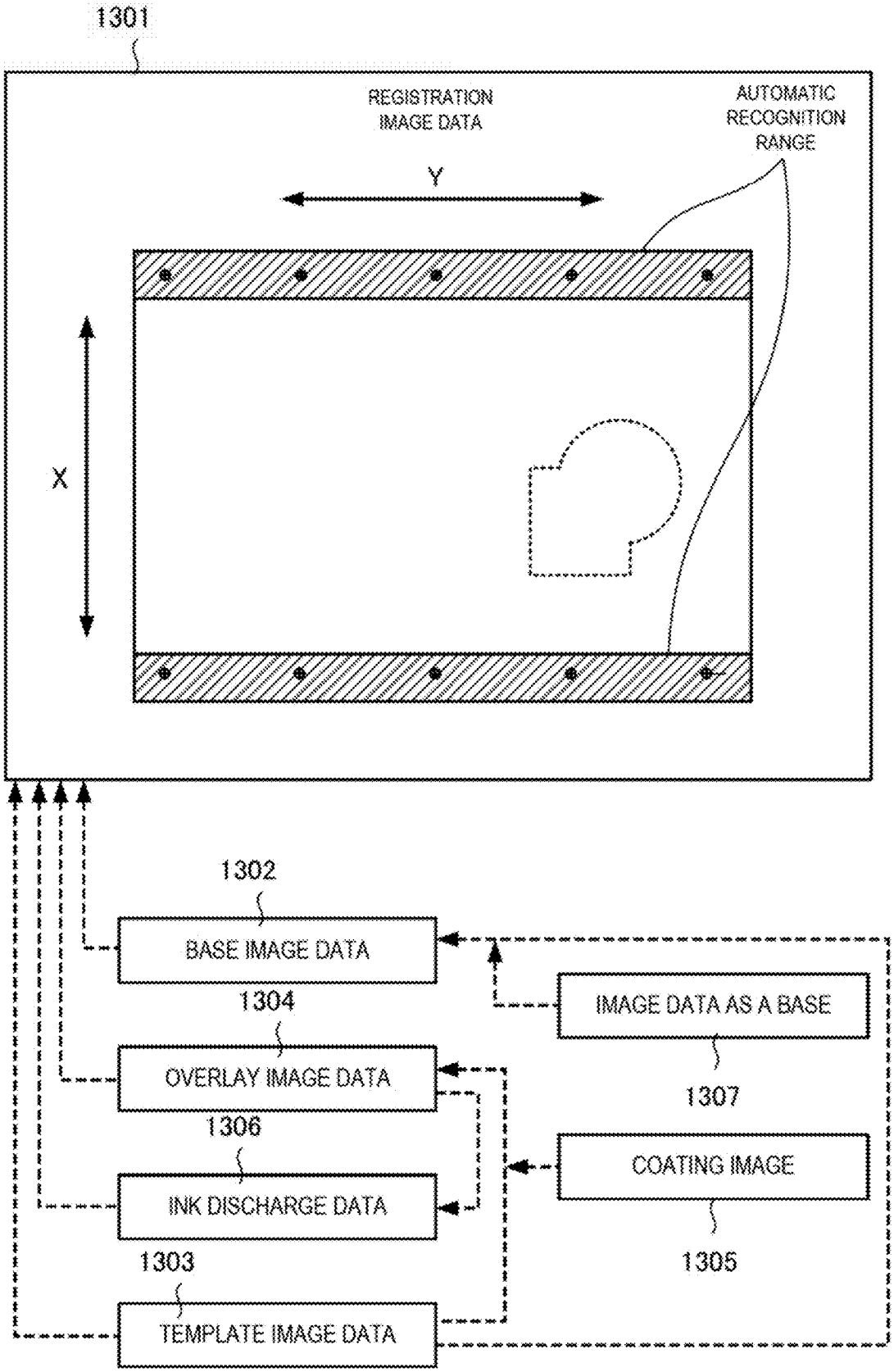
FIG. 13A is a block diagram for explaining the sequence of generating theoretical position data of registration marks by performing image processing on registration image data by a registration mark theoretical position generator according to the second example embodiment of the present invention.

As shown in FIG. 13A, the registration image data 1301 may be base image data 1302 representing a base image printed in advance before coating printing. In this case, the base image data 1302 may be one obtained by adding the image data 1307 to be printed as a base to a template image (frame image) 1303 in which cutting position designation marks, the registration marks 601, or the like are rendered in advance.

The registration image data 1301 may be overlay image data 1304 representing a coating image subjected to coating printing. In this case, the user need not read a base image and an overlay image separately, and this can save the labor. Also, in this case, the registration image data 1301 may be one obtained by adding an overlay image to a template image (frame image) 1303 in which cutting position designation marks, the registration marks 601, or the like are rendered in advance.

The registration image data 1301 may be a template image (frame image) 1303 in which cutting position designation marks, the registration marks 601, or the like are rendered in advance.

The registration image data 1301 may be ink discharge data 1306 generated from overlay image data 1304 representing a coating image 1305 subjected to coating printing.

The image processing employed here includes any one of the blob analysis method, the feature point extraction method, the contrast comparison method, pattern matching, and the geometry calculation/comparison method.

As the geometry calculation/comparison method, a method may be employed in which the area and outer perimeter of an image that seems to be a registration mark are obtained and whether the image is a registration mark is determined. For example, when the outer shape of a registration mark is a circle, the square $c^2=4(\pi r)^2$ of a perimeter C of a contour extracted by binarizing registration image data is divided by four times $4\pi r^2$ of the area, and whether the contour is a circle is determined based on whether the result is close to $\pi$.

That is, registration image data is binarized, then contour extraction processing is performed, and it is determined whether the area and outer perimeter of an extracted outer shape contour have a predetermined relationship (outer shape contour determination). If the area and the outer perimeter have a predetermined relationship, whether a predetermined characteristic shape is contained in the outer shape contour is determined using pattern matching based on the contrast comparison method (internal shape determination).

For example, when a registration mark is a circled cross, it can be recognized with higher precision by performing pattern matching with a cross image smaller than a prospective cross. Also, when a registration mark is a circled cross, pattern matching may be done for four shapes dividing the inside of the circle.

The theoretical position of a registration mark may be derived as a numerical value by obtaining the barycenter of an image that seems to be a registration mark.

Since a registration mark has a shape that overlaps an original mark before rotation after rotating through a predetermined angle of less than 360°, it suffices to perform image processing within a predetermined angle range (for example, about 10°).

As shown in FIG. 13A, the registration mark theoretical position generator 1105 automatically recognizes a direction and range in which extraction processing of a registration mark is performed in registration image data. In particular, the direction is determined based on a paper size specified by the user.

A user interface that presents a range subjected to extraction processing of a registration mark may be displayed on the preview screen.

When a registration mark is a mark obtained by adding a straight line passing through the barycenter to the inside of a circle, it is more easily recognized by the above-described image processing advantageously.

Since a range and a direction can be designated in image processing, the processing time can be shortened greatly compared to a case in which image processing is performed on entire registration image data.

Registration marks are often formed at peripheral portions that are cut off after the completion of printing. In this case, it is designated to perform image processing at only peripheral portions where registration marks exist. For example, when registration marks are formed in pairs in the widthwise direction, as in FIG. 6, two edge portions (upper and lower edge portions in FIG. 6) in the widthwise direction are designated as image processing targets. The registration mark theoretical position generator 1105 automatically recognizes registration marks only in the two edge portions based on the paper size specified by a user. Alternatively, users can specify registration marks by using the user interface. For example, the registration mark theoretical position generator 1105 may recognize registration marks in an area specified by the user. In this case, the registration mark theoretical position generator 1105 may acquire boundary coordinates indicating the boarder of the area specified by the user and then using the boundary coordinates, convert the position of the registration mark into coordinates in the registration image.

Registration marks are printed originally at the same time as a base image and considered to be contained in the base image. By performing object analysis of the base image, the positions of the registration marks of a predetermined shape in the base image are analyzed to specify the theoretical positions of the registration marks.

In this example embodiment, the registration mark theoretical position generator 1105 filters out error positions from the theoretical positions of the registration mark which the corrector 842 compares with reading positions. The error positions are specified by using non-registration mark images which are similar to a registration mark.

In this example embodiment, registration marks are placed evenly in each of two lines along both long sides of the substrate 303 and are symmetry with respect to a center line between the two long sides (as shown in FIG. 6). The registration marks in the registration image data are positioned as well. The registration marks should not be existed greatly apart from the two lines. Therefore, the corrector 842 does not compare the theoretical positions which are greatly apart from the two lines. The registration mark theoretical position generator 1105 derives positions on the X-axis of the two lines by using a plurality of theoretical positions of specified registration marks. The registration mark theoretical position generator 1105 specifies positions on the X-axis where most of the registration marks exist, as the positions of the two lines.

The registration mark theoretical position generator 1105 derives positions on the X-axis of the two lines by using a plurality of theoretical positions of specified registration marks. The corrector 842 does not compare the theoretical positions which are greatly apart from the two lines. The corrector 842 uses the theoretical positions which are positioned within predetermined pixels from the two lines because such gap is occurred from an error in RIP (Raster image processor) processing or in designing. In this example embodiment, the corrector 842 corrects coating image data by using reading position data acquired by reading two positions of two registration marks symmetrically printed in advance on conveyed paper. When the registration mark theoretical position generator 1105 find out one registration mark in the registration image data, the registration mark theoretical position generator 1105 determines whether or not another registration mark exist symmetric area in X-axis. If another registration mark is not existed in the symmetric area due to deletion as an operation error by designers or as an processing of designer's tool or workflow tool for processing after designing, the corrector 842 does neither use the one registration mark for comparison nor capture the area.

The parameter input unit 1106 inputs various parameters via the user interface 1200. The thickness upper limit setting unit 1107 sets the upper limit value (for example, 20 μm to 80 μm) of the thickness of coating printing input by the parameter input unit 1106. The thickness tone determiner 1108 determines the tone of the thickness of coating printing in accordance with the upper limit value of the coating thickness set by the thickness upper limit setting unit 1107. For example, when the upper limit value of the coating thickness is 20 μm, two tones of no coating (0 μm) and 20 μm are set. For example, when the upper limit value of the coating thickness is 80 μm, eight tones of no coating (0 μm), 20 μm, 30 μm, 40 μm, 50 μm, 60 μm, 70 μm, and 80 μm are set. Although 10 μm is not set in this example embodiment, it may be set to include 10 μm in accordance with demand.

The threshold changer 1111 changes a threshold (pixel value) for coating thickness adjustment in accordance with an input from the parameter input unit 1106.

The thickness setting unit 1112 sets different coating thicknesses between an image region having a pixel value of a threshold or more set by the threshold changer 1111 and an image region having a pixel value of smaller than the threshold in image data designated by the image data designator 1102.

The cost calculator 1113 calculates a cost required when coating printing corresponding to image data is performed at a coating thickness set by the thickness setting unit 1112.

The job transmitter 1114 controls the inkjet printing apparatus 203 to perform coating printing on an image region set by the thickness setting unit 1112 at a coating thickness set by the thickness setting unit 1112.

<Arrangement of User Interface>

FIG. 12 is a view showing an example of the user interface 1200.

A paper size button 1201 is a button for activating a paper size setup dialog box (not shown) and selecting a paper size from a paper size list or setting a custom size.

An image data button 1202 is a button for designating image data. In accordance with a selection from this button, the image data designator 1102 designates image data for coating printing from image data stored in the image database 1120 of the information processing apparatus 201.

When a registration theoretical position generation button 1203 is selected, the registration mark theoretical position generator 1105 activates a dialog box (not shown), performs image processing on input image data, and generates and saves theoretical position data of registration marks.

A correction mode button 1205 is a button for designating a correction mode when correcting a position of coating printing using registration marks. "Real-time", "leading end/trailing end", "leading end", and "manual" can be selected from a pull-down menu. In real-time correction, all registration marks printed on a conveyed substrate are read and collated with registration mark data in image data. In leading end/trailing end correction, only registration marks at the leading and trailing ends of a conveyed substrate are read and collated with registration mark data in image data. In leading end correction, only registration marks at the leading end of a conveyed substrate are read and collated with registration mark data in image data. "Manual" is used when no registration mark is printed on a conveyed substrate.

A finishing thickness setting slide bar 1206 is a slide bar for setting the upper limit of a coating thickness, and a handle 1261 can be moved left and right. In accordance with the position of the handle 1261, the thickness upper limit setting unit 1107 sets the upper limit value (for example, 20 μm to 80 μm) of a coating thickness, and the thickness tone determiner 1108 determines the tone (from two to eight tones here) of the thickness of coating printing.

A preview tab 1207 is used to display a preview screen, and an image corresponding to image data designated by the image data button 1202 is displayed in a display area 1208. Only an image corresponding to image data for coating printing is displayed here, but it is also possible to read out image data for base printing and display the base image at the same time as a coating image. For example, the coating image may be displayed transparently, and superimposed and displayed on the base image. Alternatively, the coating image and the base image may be displayed side by side.

An image edit button 1209 is a button for calling an application designed to edit a previewed image. In response to the selection of this button, the image edit application caller 1104 calls an application for editing image data.

An image reread button 1210 is a button for rereading a previewed image. A printing cost confirmation button 1211 is a button for displaying a printing cost confirmation dialog box (not shown). The printing cost confirmation dialog box enables inputting the price of coating ink and the number of prints. In accordance with input numerical values, a printing cost when coating printing is performed at a set coating thickness is calculated and displayed.

A thickness threshold tab 1212 is a tab for displaying in the display area 1208 a screen for changing a threshold (pixel value) for coating thickness adjustment.

A list button 1213 is a button for displaying a job history and a job list. An open button 1214 is a button for opening a saved job and displaying it in a job window. A save button 1215 is a button for saving a created job. A new button 1216 is a button for creating a new job. A send button 1217 is a button for sending a job displayed in the job window to the inkjet printing apparatus 203.

A function button 1218 is a button for performing power-on/off of the inkjet printing apparatus 203, setting of the irradiation time of the active energy ray irradiator 424, energy saving setting, setting of the number of feed test sheets, and the like.

A monitor button 1219 is a button for monitoring the state of the inkjet printing apparatus 203. In response to the selection of this button, the presence/absence of error generation, an error generation portion, an error code, the remaining amount of ink, and the like are displayed.

When a job is sent to the inkjet printing apparatus 203 successfully by the send button 1217, action buttons 1221 to 1228 are displayed in color and become selectable. The paper feed test button 1221 is a button for feeding a set number of sheets without printing. The test button 1222 is a button for performing all processes on only one sheet. The start button 1223 is a button for starting print processing. The stop button 1224 is a button for stopping print processing. The numerical value input button 1225 is a button for displaying a numerical value input screen and inputting the number of sheets. The count clear button 1226 is a button for clearing the number of printed sheets or the number of sheets. The count method switching button 1227 is a button for switching the display form of the number of printed sheets between addition and subtraction. The count repeat setting button 1228 is a button for setting ON/OFF of the count repeat. When the count repeat is ON, the inkjet printing apparatus 203 automatically stops upon completion of print processing by a set number of copies. When the count repeat is OFF, the number of processed copies in the inkjet printing apparatus 203 is cleared upon completion of print processing and the inkjet printing apparatus 203 enters the waiting mode.

A series of operations from the operation of the send button 1217 to entrance of the waiting mode may be performed automatically using printed or adhered identification information.

<Processing Sequence>

Figure 13B:
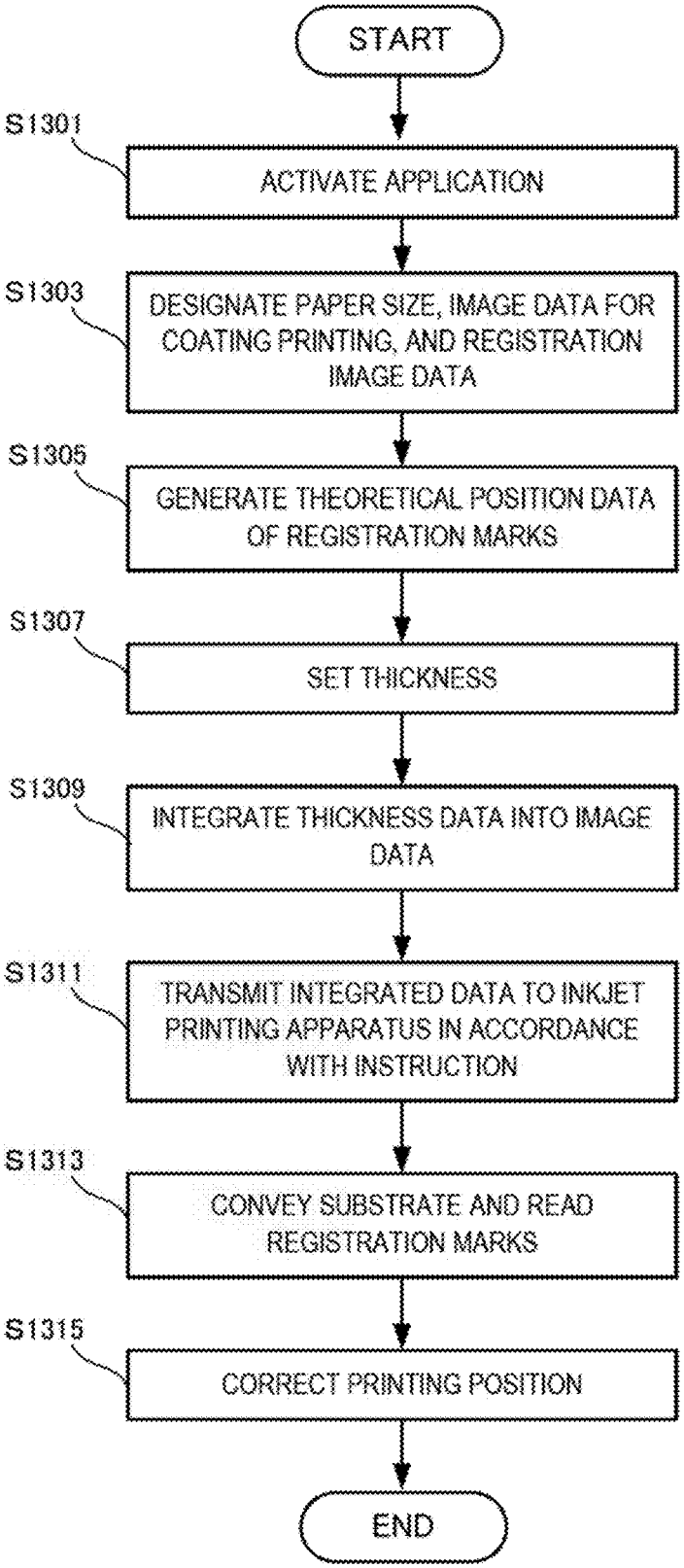
FIG. 13B is a flowchart for explaining the sequence of processing of the information processing apparatus according to the second example embodiment of the present invention.

The processing sequence of the printing system 2000 will be explained with reference to the flowchart of FIG. 13B.

First, in step S1301, a control application for the inkjet printing apparatus 203 is activated. Accordingly, the user interface 1200 is displayed. Then, in step S1303, a paper size, image data for coating printing, and registration image data are designated based on inputs to the user interface 1200. In step S1305, the thickness upper limit setting unit 1107 sets the upper limit value of the thickness in accordance with the position of the handle 1261 on the finishing thickness setting slide bar 1206.

In step S1307, the thickness threshold tab 1212 is selected, a threshold (pixel value) for coating thickness adjustment is changed, and a coating thickness is set.

In step S1309, an image is edited as needed, the cost is confirmed, and the thickness data is integrated into the image data. In step S1311, the integrated data is transmitted to the inkjet printing apparatus 203 in accordance with a user instruction.

Figure 14:
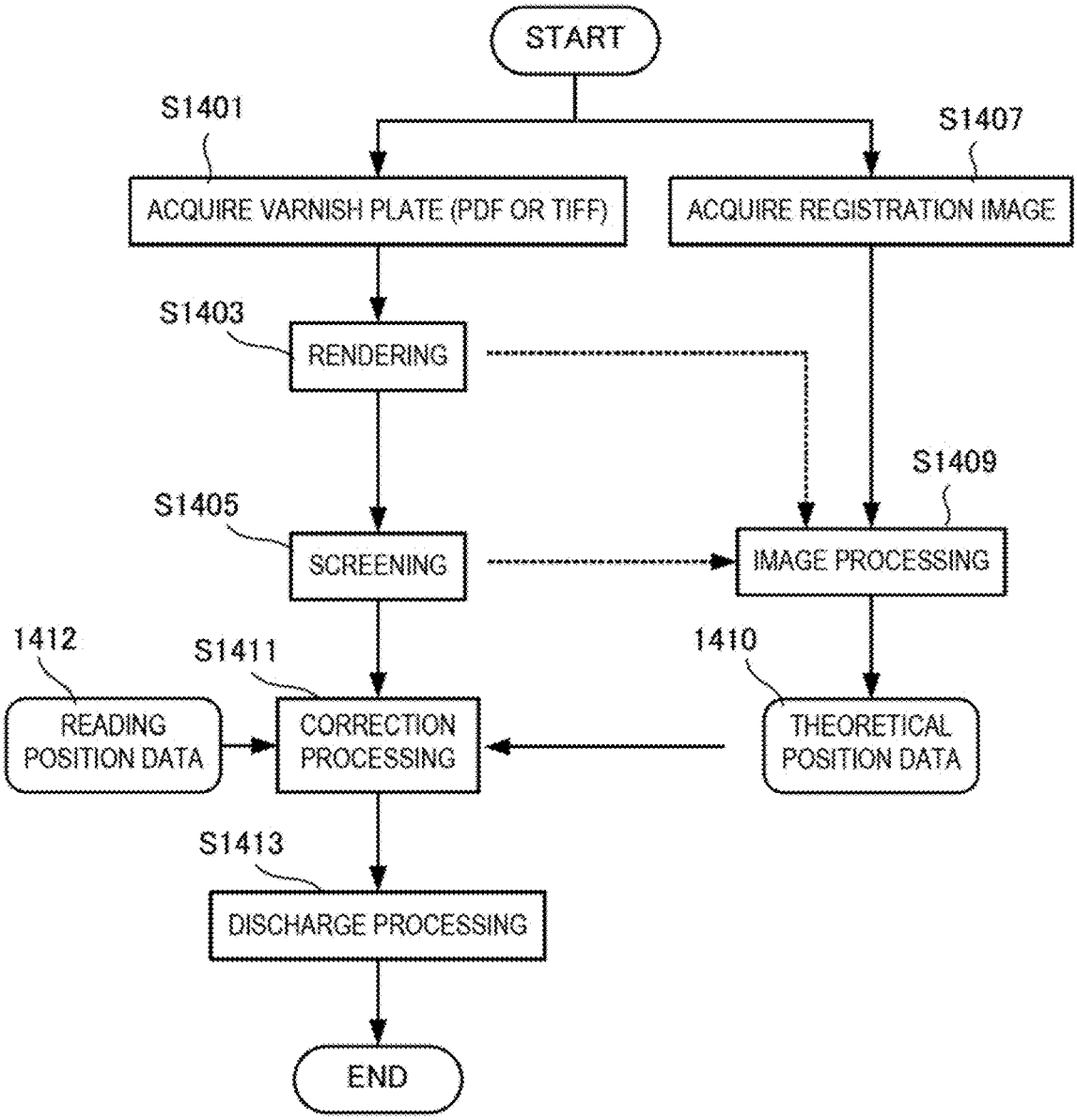
FIG. 14 is a flowchart for explaining the sequence of image processing of the printing system according to the second example embodiment of the present invention.

Further, the sequence of image processing in the printing system 200 will be explained with reference to the flowchart of FIG. 14.

In step S1401, image data (above-mentioned coating image of, e.g., the PDF or TIFF format) for coating printing called a varnish plate is acquired.

In step S1403, rendering processing is performed as RIP (Raster Image Processor) processing on the varnish plate to generate a rater image (bitmap image), and a pixel value serving as the reference of thickness setting information is acquired.

In step S1405, screening processing is performed, and the image is converted into data to be actually transmitted to the inkjet heads 726 so as to perform printing at a thickness based on the pixel value and the threshold.

The information processing apparatus 201 acquires a registration image (base image+registration marks) in step S1407, performs image processing in step S1409, and generates theoretical position data 1410 of the registration marks.

Further, in step S1411, reading position data 1412 of the registration marks separately read by a CCD sensor is compared with the theoretical position data 1410, and correction processing is performed on discharge data after screening processing.

In step S1413, discharge processing based on the discharge data is performed.

With the above-described arrangement, the theoretical positions of registration marks can be obtained very easily and simply, and high-precision coating printing can be performed without requiring a cumbersome operation of a user.

Third Example Embodiment

Figure 15:
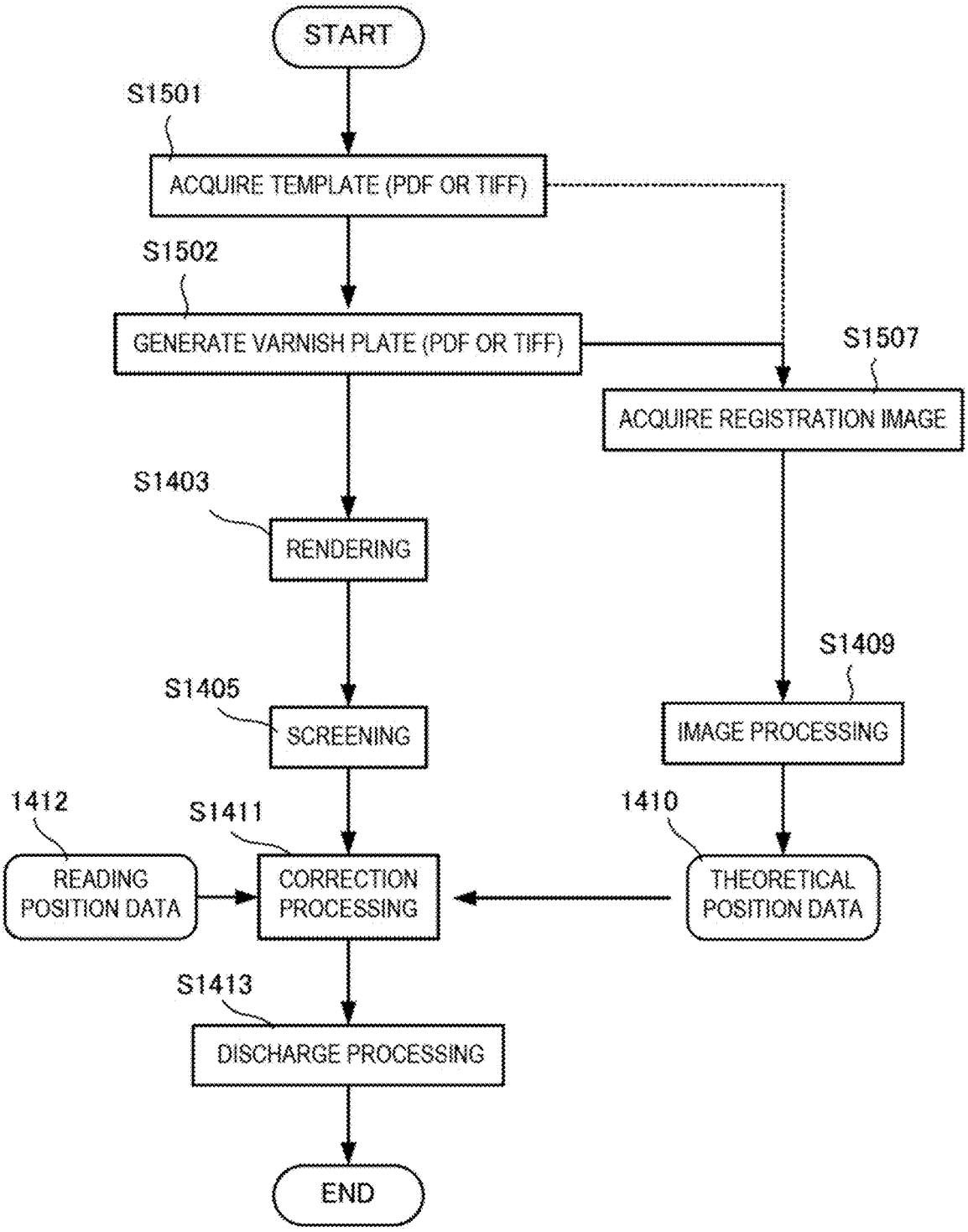
FIG. 15 is a flowchart for explaining the sequence of image processing of a printing system according to the third example embodiment of the present invention.

The sequence of image processing in an inkjet printing apparatus according to the third example embodiment of the present invention will be described below with reference to the flowchart of FIG. 15. In the inkjet printing apparatus according to the third example embodiment, unlike the second example embodiment, template image data in which registration marks are arranged in advance is acquired in step S1501. Then, in step S1502, image editing is performed on the template image data and a varnish plate is generated. In step S1507, the template image data itself or overlay image data obtained by adding a coating image to the template image data is acquired as registration image data. That is, such template image data or overlay image data is subjected to image processing of generating theoretical position data 1410 of registration marks.

By executing the above-mentioned processing, accurate theoretical positions of registration marks can be acquired and higher-precision image printing becomes possible without performing a cumbersome operation by a user.

Fourth Example Embodiment

Figure 16:
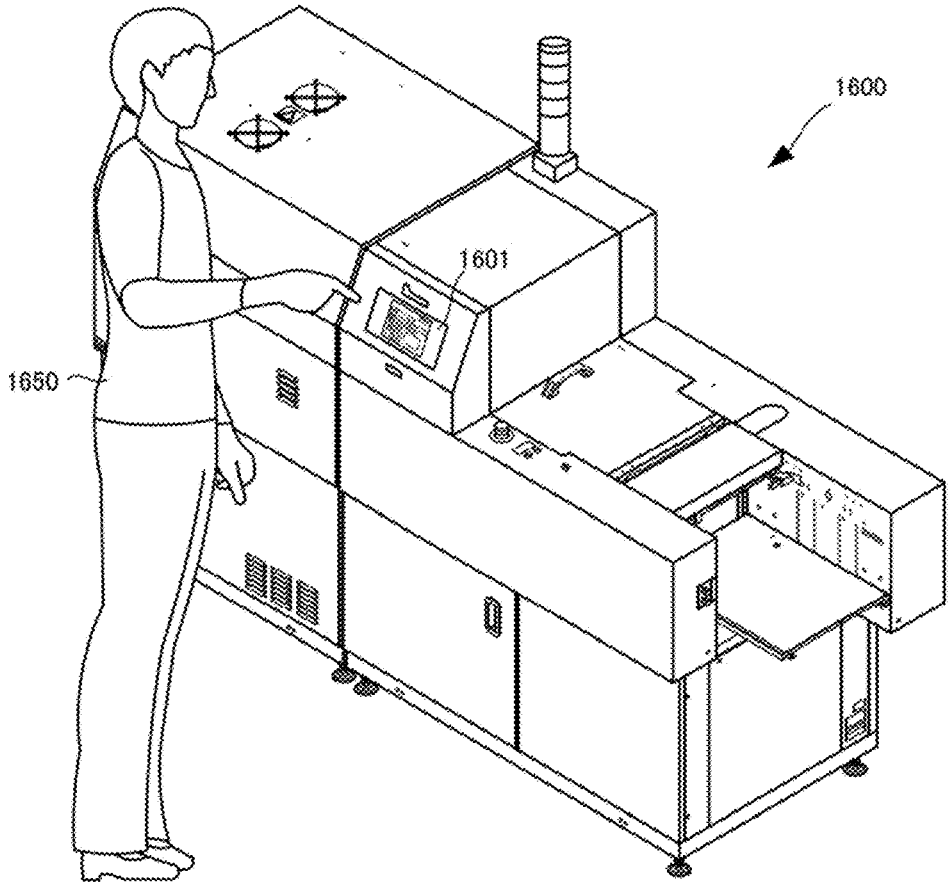
FIG. 16 is a view showing the outer appearance of an inkjet printing apparatus according to the fourth example embodiment of the present invention.

An inkjet printing apparatus 1600 according to the fourth example embodiment of the present invention will be described below with reference to FIG. 16. FIG. 16 is a view showing the outer appearance of the inkjet printing apparatus 1600 according to this example embodiment. Unlike the second example embodiment, the inkjet printing apparatus 1600 according to the fourth example embodiment includes a display 1601 for displaying a user interface 1200 shown in FIG. 12, and incorporates a registration mark theoretical position generator 1105 shown in FIG. 11. The remaining arrangement and operation are the same as those in the second example embodiment, the same reference numerals denote the same arrangement and operation, and a detailed description thereof will not be repeated.

According to this example embodiment, a user 1650 can directly operate the inkjet printing apparatus 1600 and execute high-precision coating printing easily and intuitively.

Other Example Embodiments

While the invention has been particularly shown and described with reference to example embodiments thereof, the invention is not limited to these example embodiments. It will be understood by those of ordinary skill in the art that various changes in form and details may be made therein without departing from the spirit and scope of the present invention as defined by the claims.

The present invention is applicable to a system including a plurality of devices or a single apparatus. The present invention is also applicable even when an information processing program for implementing the functions of example embodiments is supplied to the system or apparatus directly or from a remote site. Hence, the present invention also incorporates the program installed in a computer to implement the functions of the present invention by the computer, a medium storing the program, and a WWW (World Wide Web) server that causes a user to download the program. Especially, the present invention incorporates at least a non-transitory computer readable medium storing a program that causes a computer to execute processing steps included in the above-described example embodiments.

What is claimed is:

1. A printing system including a printing apparatus capable of further performing coating printing on a substrate having undergone printing, comprising:

an image data analyzer that analyzes registration image data which contains a registration mark and which is acquired from a storage medium to generate theoretical position data comprising a theoretical position of the registration mark;

an acquirer that acquires sensed position data by sensing a position of a registration mark printed in advance on conveyed paper; and a printing controller that compares the theoretical position data with the sensed position data and corrects a position of coating printing based on a difference between the theoretical position of the registration mark and the sensed position of the registration mark.

2. The system according to claim 1, wherein the registration image data is base image data representing a base image printed in advance before the coating printing.

3. The system according to claim 2, wherein the base image data is data obtained by adding image data to be printed as a base to template image data in which a registration mark is arranged in advance.

4. The system according to claim 1, wherein the registration image data is overlay image data representing a coating image subjected to the coating printing.

5. The system according to claim 4, wherein the overlay image data is data obtained by adding a coating image subjected to the coating printing to template image data in which a registration mark is arranged in advance.

6. The system according to claim 1, wherein the registration image data is template image data in which a registration mark is arranged in advance.

7. The system according to claim 1, wherein the registration image data is ink discharge data generated from overlay image data representing a coating image subjected to the coating printing.

8. The system according to claim 1, wherein said generator extracts the theoretical position data of the registration mark from the registration image data by performing image processing including any one of a blob analysis method, a feature point extraction method, a contrast comparison method, pattern matching, and a geometry calculation/comparison method.

9. A printing system including a printing apparatus capable of further performing coating printing on a substrate having undergone printing, comprising:

a generator that generates theoretical position data of a registration mark by performing image processing on registration image data assumed to contain a registration mark;

an acquirer that acquires reading position data by reading a position of a registration mark printed in advance on conveyed paper; and a printing controller that compares the theoretical position data with the reading position data and corrects a position of coating printing based on misregistration, wherein said generator extracts the theoretical position data of the registration mark from the registration image data by performing image processing including any one of a blob analysis method, a feature point extraction method, a contrast comparison method, pattern matching, and a geometry calculation/comparison method, and wherein the geometry calculation/comparison method is a method of obtaining an area and outer perimeter of an image that seems to be a registration mark, and determining whether the image is a registration mark.

10. A printing system including a printing apparatus capable of further performing coating printing on a substrate having undergone printing, comprising:

a generator that generates theoretical position data of a registration mark by performing image processing on registration image data assumed to contain a registration mark;

an acquirer that acquires reading position data by reading a position of a registration mark printed in advance on conveyed paper; and a printing controller that compares the theoretical position data with the reading position data and corrects a position of coating printing based on misregistration, wherein said generator extracts the theoretical position data of the registration mark from the registration image data by performing image processing including any one of a blob analysis method, a feature point extraction method, a contrast comparison method, pattern matching, and a geometry calculation/comparison method, and, wherein said generator obtains a barycenter of an image that seems to be a registration mark, and derives a theoretical position of the registration mark as a numerical value.

11. The system according to claim 1, wherein the registration mark is a mark containing a characteristic shape in an outer shape having a geometric shape.

12. The system according to claim 1, wherein the registration mark is a mark that overlaps an original mark before rotation after rotating through a predetermined angle of less than 360°.

13. The system according to claim 1, further comprising a function that automatically recognizes a direction and a range in which image processing for extracting the registration mark is performed.

14. A printing system including a printing apparatus capable of further performing coating printing on a substrate having undergone printing, comprising:

a generator that generates theoretical position data of a registration mark by performing image processing on registration image data assumed to contain a registration mark;

an acquirer that acquires reading position data by reading a position of a registration mark printed in advance on conveyed paper; and a printing controller that compares the theoretical position data with the reading position data and corrects a position of coating printing based on misregistration, wherein said generator includes:

an outer shape contour determiner that binarizes the registration image data, performs contour extraction processing, and determines whether an area and outer perimeter of an extracted outer shape contour have a predetermined relationship; and an internal shape determiner that, when the area and the outer perimeter have the predetermined relationship, determines using pattern matching based on the contrast comparison method whether a predetermined characteristic shape is contained in the outer contour.

15. The system according to claim 1, wherein when a pair of registration marks exists near opposite sides facing in a longitudinal direction or a lateral direction among the theoretical positions of registration marks generated by said generator, said printing controller uses the pair of registration marks as a target of comparison with the reading position data.

16. The system according to claim 1, wherein the printing apparatus includes an image capturer that captures an image of conveyed paper, and when a pair of registration marks exists near opposite sides facing in a longitudinal direction or a lateral direction among the theoretical positions of registration marks generated by said generator, said printing controller sets theoretical positions of the pair of registration marks as positions of image capturing by said image capturer.

17. An inkjet printing apparatus that further performs coating printing on a substrate having undergone printing, comprising:

an image data analyzer that analyzes registration image data which contains a registration mark and which is acquired from a storage medium to generate a theoretical position data comprising a theoretical position of the registration mark;

an acquirer that acquires sensed position data by sensing a position of a registration mark printed in advance on conveyed paper; and a printing controller that compares the theoretical position data with the sensed position data and corrects a position of coating printing based on a difference between the theoretical position of the registration mark and the sensed position of the registration mark.

18. A control method of controlling a printing apparatus capable of further performing coating printing on a substrate having undergone printing, comprising:

analyzing registration image data which contains a registration mark and which is acquired from a storage medium to generate theoretical position data comprising a theoretical position of the registration mark;

acquiring sensed position data by sensing a position of a registration mark printed in advance on conveyed paper; and comparing the theoretical position data with the sensed position data to correct a position of coating printing based on a difference between the theoretical position of the registration mark and the sensed position of the registration mark.

* * * * *